US011464306B2

(12) United States Patent
Peng

(10) Patent No.: US 11,464,306 B2
(45) Date of Patent: Oct. 11, 2022

(54) REUSABLE DRINKING STRAW SYSTEM

(71) Applicant: Pandian Peng, Shenzhen (CN)

(72) Inventor: Pandian Peng, Shenzhen (CN)

( * ) Notice: Subject to any disclaimer, the term of this patent is extended or adjusted under 35 U.S.C. 154(b) by 0 days.

(21) Appl. No.: 17/240,490

(22) Filed: Apr. 26, 2021

(65) Prior Publication Data

US 2022/0167722 A1 Jun. 2, 2022

(51) Int. Cl.
*A45C 11/24* (2006.01)
*A47G 21/18* (2006.01)

(52) U.S. Cl.
CPC ..... *A45C 11/24* (2013.01); *A47G 21/186* (2013.01)

(58) Field of Classification Search
CPC ..... B65D 77/28; B65D 2517/0049; B65D 77/283; B65D 51/32; A47G 19/2222; A47G 21/18
USPC ..... 215/229; 220/230, 256.1, 707, 708, 709, 220/705, 710; 401/129; 239/33, 24
See application file for complete search history.

(56) References Cited

U.S. PATENT DOCUMENTS 3,030,651 A * 4/1962 Bowen, Jr. ..... B65D 51/32 401/125
3,139,212 A * 6/1964 Stallard ..... B65D 51/26 356/244
3,874,554 A * 4/1975 Chang ..... B65D 77/28 206/217
4,036,392 A * 7/1977 Martin ..... B65D 77/28 206/217
4,074,827 A * 2/1978 Labe, III ..... B65D 51/28 206/217
4,615,457 A * 10/1986 Harding ..... B65D 77/28 220/709
4,728,001 A * 3/1988 Serba ..... B65D 77/283 215/388
D296,874 S * 7/1988 Dallas ..... D9/436
4,923,083 A * 5/1990 Forbes ..... B65D 17/4012 215/388
5,054,631 A * 10/1991 Robbins, III ..... A47G 21/18 220/666
5,277,326 A * 1/1994 Chiba ..... A47J 27/002 99/403
5,520,304 A * 5/1996 Lin ..... A47G 19/2211 215/229
5,579,948 A * 12/1996 Lin ..... B65D 47/2012 215/229
5,582,320 A * 12/1996 Lin ..... B65D 47/2043 215/229
5,769,263 A * 6/1998 Willingham ..... B65D 51/28 215/6
6,116,446 A * 9/2000 Haughton ..... B65D 77/28 215/388

(Continued)

*Primary Examiner* — King M Chu
*Assistant Examiner* — Prince Pal

(57) ABSTRACT

A reusable drinking straw system, comprising an upper cover a lower cover, a flexible straw, wherein the lower cover is internally provided with a baffle wall and a central pole, wherein the lower cover further comprising a positioning wall, wherein a straw groove is formed between the upper cover, wherein the flexible straw is capable of being disposed in the straw groove, wherein the flexible baffle wall further comprising an opening, wherein the flexible straw has a first distal end and a second distal end, wherein the first distal end and second distal end of the flexible straw protrudes pass the opening and wedges between the baffle wall and the central pole.

9 Claims, 3 Drawing Sheets

(56) References Cited

U.S. PATENT DOCUMENTS 6,694,184 B2 * 2/2004 Cappa ..... A61N 1/37211 607/31
7,121,420 B2 * 10/2006 Baudin ..... B65D 51/18 220/366.1
7,841,485 B1 * 11/2010 Rodriguez ..... B65D 17/4012 220/708
8,376,173 B2 * 2/2013 Britto ..... B65D 47/066 206/217
8,495,803 B2 * 7/2013 Fiedler ..... H01F 7/0263 70/160
8,899,435 B1 * 12/2014 Reder ..... A47G 19/2205 220/630
9,592,935 B1 * 3/2017 Jacob ..... B65D 41/0407
9,845,172 B2 * 12/2017 Jacob ..... B65D 1/0246
10,123,641 B1 * 11/2018 Pepper ..... A47G 21/189
10,888,186 B2 * 1/2021 Pepper ..... B65D 43/163
11,167,905 B2 * 11/2021 Mavrianos ..... A47G 19/2205
11,310,994 B2 * 4/2022 Casale ..... B65D 43/165
2005/0115967 A1 * 6/2005 Conaway ..... A47G 19/2266 220/254.1
2006/0060556 A1 * 3/2006 Lee ..... B65D 51/246 215/388
2006/0180593 A1 * 8/2006 White ..... A47G 21/182 220/705
2009/0194534 A1 * 8/2009 Pineiro ..... B65D 77/28 220/212
2011/0017755 A1 * 1/2011 Tavella ..... B65D 77/28 220/708
2011/0073601 A1 * 3/2011 Komatsuda ..... A45D 40/18 220/230
2011/0108560 A1 * 5/2011 Ravelo ..... B65D 77/283 220/705
2012/0160851 A1 * 6/2012 Chiang ..... B65D 47/066 220/360
2012/0168325 A1 * 7/2012 Suarez, Jr. ..... A47G 19/065 206/217
2013/0277329 A1 * 10/2013 DeFelice ..... B65D 83/0055 215/229
2014/0332528 A1 * 11/2014 Blum ..... B65D 81/3869 220/8
2015/0114965 A1 * 4/2015 Tobey ..... B65D 47/043 220/256.1
2015/0313390 A1 * 11/2015 Russo ..... B65D 1/265 220/212
2016/0176587 A1 * 6/2016 Heraud ..... B65D 43/02 220/230
2016/0286992 A1 * 10/2016 Sladics ..... A47G 19/2222

* cited by examiner

REUSABLE DRINKING STRAW SYSTEM

FIELD OF INVENTION

The present invention relates to a reusable drinking straw system, more specifically, a reusable drinking straw with a casing.

BACKGROUND

A large number of plastic straws are being used each day in the United States. Those single use plastic straws create many environmental problems that results in permanent damages to the ecosystem and wildlife. One solution to deal with the problems created by those plastic straws is to create a reusable straws system for people to bring with them everywhere. So, they can use the reusable straws rather than a single-use straw whenever there is a need for a straw. Therefore, there is a need for a convenient reusable drinking straw system that is both easy to be carried and keeps the straw clean.

SUMMARY

The present invention is directed to a reusable drinking straw system, comprises an upper cover (1), a lower cover (2), a flexible straw (3), wherein the lower cover (2) is internally provided with a baffle wall (21) and a central pole (25), wherein the lower cover (2) further comprising a positioning wall (23), wherein a straw groove (24) is formed between the upper cover (1), wherein the flexible is capable of being disposed in the straw groove (24).

In a preferred embodiment, the lower cover is circular-shaped, and the baffle wall (21) is circumferentially arranged inside the lower cover In another preferred embodiment, the flexible baffle wall further comprises an opening (22). The flexible straw has a first distal end (31) and a second distal end (32). The first distal end and second distal end of the flexible straw protrudes pass the opening (22) and wedges between the baffle wall and the central pole.

In another preferred embodiment, the inner ring of the retaining wall (21) is provided with a plurality of slots for clamping a straw brush.

In another preferred embodiment, at least one of the two adjacent edges of the upper cover (1) and the lower cover (2) is provided with a groove (A).

In another preferred embodiment, the baffle wall (21) is enclosed to form an oval shape, and the clamping groove (26) is arranged along a cavity formed inside the baffle wall.

In another preferred embodiment, the periphery of the outer edge of the baffle wall is provided with at least one limit buckle for keeping the flexible straw in place.

In another preferred embodiment, the positioning wall (23) is obliquely arranged to the upper cover (1).

In another preferred embodiment, the upper cover (1) and the lower cover (2) are respectively provided with a first coupling part (11) and a second coupling part, (12) wherein the first coupling part and the second coupling part can be connected.

In another preferred embodiment, the first coupling part (11) further comprising a magnet, and the second coupling part (12 further comprising a metal.

BRIEF DESCRIPTION OF THE DRAWINGS

The accompanying drawings, which are included to provide further understanding of the present invention disclosed in the present disclosure and are incorporated in and constitute a part of this specification, illustrate aspects of the present invention and together with the description serve to explain the principles of the present invention.

In the drawings.

DETAILED DESCRIPTION

The detailed description set forth below is intended as a description of various configurations of the present invention and is not intended to represent the only configurations in which the present invention may be practiced. It will be apparent, however, to those of ordinary skill in the art that the present invention is not limited to the specific details set forth herein and may be practiced without these specific details.

Figure 1:
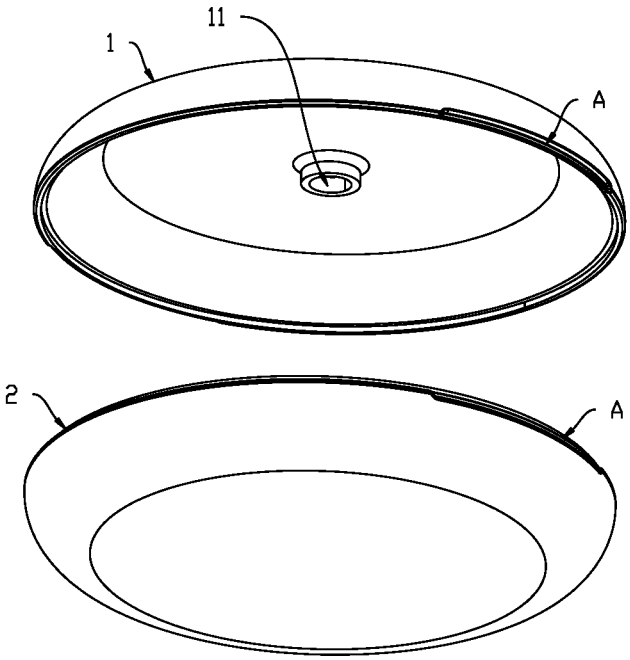
FIG. 1 is an exploded bottom perspective view of the straw system wherein the casing of the straw is circular-shaped.

In FIG. 1, a reusable drinking straw system can comprise an upper cover (1), a lower cover (2), a flexible straw (3), wherein the lower cover (2) is internally provided with a baffle wall (21) and a central pole (25), wherein the lower cover (2) can further comprise a positioning wall (23), wherein a straw groove (24) is formed between the upper cover (1), wherein the flexible straw is disposed in the straw groove (24). In this embodiment, the flexible straw is placed circularly around the casing formed by the upper cover and the lower cover. The lower cover is circular-shaped, and the baffle wall (21) is circumferentially arranged inside the lower cover. The baffle wall can have a similar shape as the lower cover and can be formed inside the lower cover or fixed to the inside of the lower cover. The central pole is formed or fixed in the center of the low cover.

Figure 2:
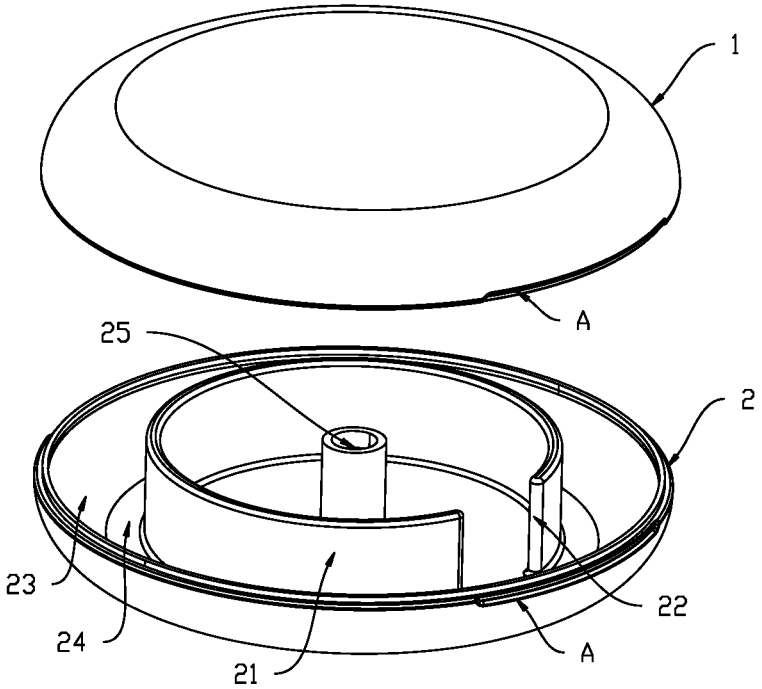
FIG. 2 is an exploded top perspective view of the straw system wherein the casing of the straw is circular-shaped.
Figure 3:
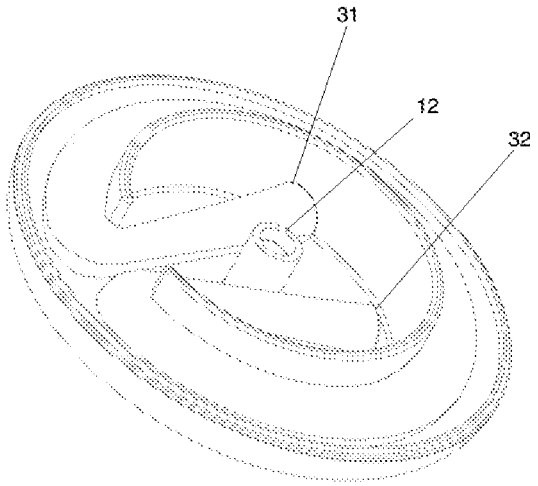
FIG. 3 is a detailed view of the lower cover of straw system with the reusable straw placed inside.

In FIG. 2, the flexible baffle wall further comprises an opening (22). The opening can be formed by cutting a notch in the baffle wall or having a baffle wall that is not complete enclosed. In FIG. 3, the flexible straw has a first distal end and a second distal end. The first distal end and second distal end of the flexible straw can protrude pass the opening (22) in the baffle wall and be wedged between the baffle wall and the central pole, therefore preventing the flexible straw from moving inside the casing.

In this embodiment, a plurality of slots for clamping a straw brush is provided inside the space encircled by the baffle wall. Sometimes, it is necessary to provide a straw brush for cleaning the flexible straw. The cleaning brush can be a flexible and foldable brush. The brush is clamped to the casing of the straw system by those slots.

In this embodiment, at least one of the two adjacent edges of the upper cover (1) and the lower cover (2) is provided with a grip groove (A). Those edges can protrude from the upper cover and the lower cover. They can also be a groove on the upper cover or lower cover. Those edges provide user a grip to open the case by splitting the upper cover and lower cover.

Figure 4:
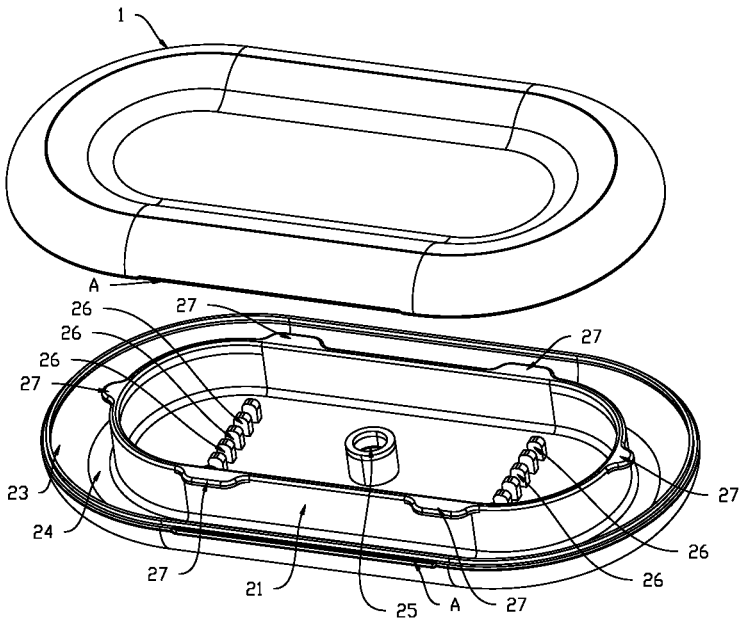
FIG. 4 is an exploded top perspective view of the straw system wherein the casing of the straw is an oval shape.
Figure 5:
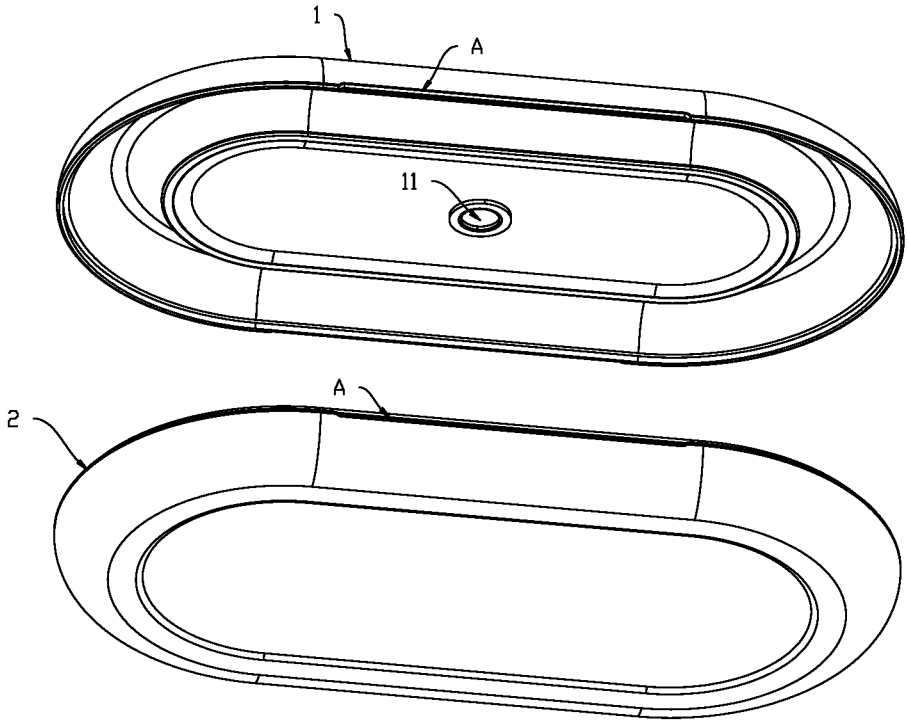
FIG. 5 is an exploded bottom perspective view of the straw system wherein the casing of the straw is an oval shape.
Figure 6:
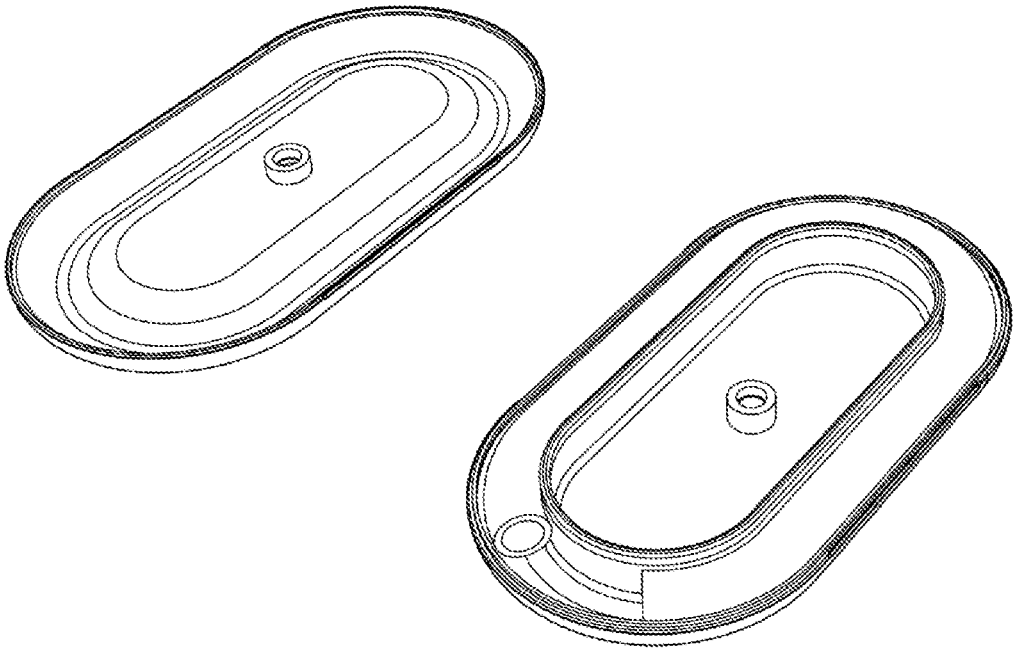
FIG. 6 is a detailed exploded view of the straw system with the reusable straw placed inside.

Referring to FIGS. 4-6, the casing of the straw system is an oval shape. Inside the casing, the baffle wall (21) is enclosed to form an oval shape, and the clamping groove (26) is arranged along a cavity formed inside the baffle wall. The clamping grooves can be used to hold a straw brush in place which is used to clean the straw.

In another preferred embodiment, the periphery of the outer edge of the baffle wall is provided with at least one limiting buckle (27) for keeping the flexible straw in place. The flexible straw might move when it is placed inside the casing. Those limiting buckles (27) can help keeping the straw tightly fixed to the straw groove (24).

In another preferred embodiment, the upper cover (1) and the lower cover (2) are respectively provided with a first coupling part (11) and a second coupling part (12), wherein the first coupling part and the second coupling part can be connected. In some embodiments, the second coupling part can be part of the central pole. The first coupling part (11) can further comprise a magnet, and the second coupling part (12) can further comprise a metal. The first and second coupling parts are connected when the metal is attracted to the magnet and thereby couples the upper cover and lower cover together. In some embodiments, the second coupling part comprises the magnet and the first coupling part comprises the metal.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the broad scope of the following claims.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A reusable drinking straw system, comprising:
an upper cover, a lower cover, a flexible straw,
wherein the lower cover is internally provided with a baffle wall and a central pole,
wherein the lower cover further comprising a positioning wall, wherein a straw groove is formed between the upper cover and the lower cover, wherein the flexible straw is capable of being disposed in the straw groove, wherein the lower cover is circular-shaped and wherein the baffle wall is circumferentially arranged inside the lower cover, wherein the baffle wall further comprising an opening, wherein the flexible straw has two opposite ends, wherein the two opposite ends of the flexible straw protrudes pass the opening and wedges between the baffle wall and the central pole.

2. A reusable drinking straw system according to claim 1, wherein an inner ring of the baffle wall is provided with a plurality of slots for clamping a straw brush.

3. A reusable drinking straw system according to claim 1, wherein at least one of the two adjacent edges of the upper cover and the lower cover is provided with a grip groove.

4. A reusable drinking straw system according to claim 1, wherein the baffle wall is enclosed to form an oval shape, and the clamping groove is arranged along a cavity formed inside the baffle wall.

5. A reusable drinking straw system according to claim 1, wherein the periphery of the outer edge of the baffle wall is provided with at least one limiting buckle for preventing the flexible straw from falling outwards.

6. A reusable drinking straw system according to claim 1, wherein the positioning wall is obliquely arranged to the upper cover.

7. A reusable drinking straw system according to claim 1, wherein the upper cover and the lower cover are respectively provided with a first coupling part and a second coupling part, wherein the first coupling part and the second coupling part can be connected.

8. A reusable drinking straw system according to claim 7, wherein the first coupling part further comprising a magnet, and the second coupling part further comprising a metal.

9. A reusable drinking straw system according to claim 7, wherein the second coupling part further comprising a magnet, and first coupling part further comprising a metal.

* * * * *